US006681609B1

(12) United States Patent
Preddey

(10) Patent No.: US 6,681,609 B1
(45) Date of Patent: Jan. 27, 2004

(54) MOVEABLE ELEMENT KEY AND KEY HANDLE AND LOCK

(75) Inventor: Brian Francis Preddey, Gerringong (AU)

(73) Assignee: Australian Lock Company Pty. Ltd. (AU)

( * ) Notice: Subject to any disclaimer, the term of this patent is extended or adjusted under 35 U.S.C. 154(b) by 0 days.

(21) Appl. No.: 09/786,489

(22) PCT Filed: Sep. 3, 1999

(86) PCT No.: PCT/AU99/00722

§ 371 (c)(1),
(2), (4) Date: Jun. 4, 2001

(87) PCT Pub. No.: WO00/14366

PCT Pub. Date: Mar. 16, 2000

(30) Foreign Application Priority Data

Sep. 4, 1998 (AU) ..... PP 5724

(51) Int. Cl.[7] ..... E05B 27/06; E05B 19/08

(52) U.S. Cl. ..... 70/495; 70/395; 70/399; 70/408; 70/409

(58) Field of Search ..... 70/408, 409, 495, 70/399, 401, 395–397, 400, 493

(56) References Cited

U.S. PATENT DOCUMENTS

| | | | | |
|---|---|---|---|---|
| 130,609 | A | * | 8/1872 | Van Dyke |
| 167,168 | A | * | 8/1875 | Griswold |
| 188,827 | A | * | 3/1877 | Stewart |
| 485,899 | A | * | 11/1892 | Tannenberg |
| 827,201 | A | * | 7/1906 | Ash et al. |
| 888,478 | A | * | 5/1908 | Drew |
| 947,913 | A | * | 2/1910 | Jenkins |
| 1,070,757 | A | * | 8/1913 | Watson |
| 1,105,093 | A | * | 7/1914 | Monzaney |
| 1,356,747 | A | * | 10/1920 | Skolneek |

(List continued on next page.)

FOREIGN PATENT DOCUMENTS

| | | | | |
|---|---|---|---|---|
| AT | 385077 | | 2/1988 | |
| DE | 633936 | * | 8/1936 | ..... 70/398 |
| DE | 1093253 | | 11/1960 | |
| EP | 226252 | * | 6/1987 | ..... 70/495 |
| EP | 0 262 059 | | 3/1988 | |
| EP | 0 416 500 | | 3/1991 | |
| EP | 359885 | | 12/1992 | |
| ES | 2 007 674 A | | 7/1989 | |
| GB | 2 210 406 | | 6/1989 | |
| IT | 305938 | * | 2/1933 | ..... 70/399 |
| WO | WO96/20325 | | 7/1996 | |

*Primary Examiner*—Lloyd A. Gall
(74) *Attorney, Agent, or Firm*—Akerman Senterfitt, P.A.

(57) ABSTRACT

A key is provided with an actuator. The key also has operation structure and interaction structure. When the key is inserted into a lock, a force is applied to the operation structure and the position of the interaction structure is altered. The movement of the interaction structure is used in the locking and/or un-locking mechanism of the lock. A key handle and lock are also provided which incorporate such a mechanism.

28 Claims, 7 Drawing Sheets

U.S. PATENT DOCUMENTS

| | | | | | |
|---|---|---|---|---|---|
| 1,567,979 | A | * | 12/1925 | Northrop | |
| 1,735,868 | A | * | 11/1929 | Klingel | |
| 1,750,542 | A | * | 3/1930 | Pucek | |
| 2,620,694 | A | | 12/1952 | Jansson | |
| 3,313,132 | A | | 4/1967 | Wolter | |
| 3,486,355 | A | | 12/1969 | Halfyard | 70/421 |
| 3,754,422 | A | | 8/1973 | Stackhouse | 70/377 X |
| 3,968,668 | A | | 7/1976 | Epstein | 70/386 X |
| 4,040,279 | A | | 8/1977 | Signorelli et al. | 70/34 |
| 4,100,777 | A | | 7/1978 | Fredon | 70/398 X |
| 4,155,232 | A | | 5/1979 | Haus, Jr. et al. | 70/34 |
| 4,404,824 | A | * | 9/1983 | Hennessy | 70/419 X |
| 4,478,061 | A | * | 10/1984 | Preddey | 70/358 |
| 4,603,565 | A | | 8/1986 | Strassmeir | 70/358 |
| 4,624,119 | A | | 11/1986 | Newman et al. | 70/366 |
| 4,667,495 | A | | 5/1987 | Girard et al. | 70/398 |
| 4,747,282 | A | * | 5/1988 | Nyun | 70/426 |
| 4,840,049 | A | | 6/1989 | Russo | 70/34 |
| 5,076,081 | A | | 12/1991 | Boris, Jr. | 70/398 |
| 5,170,651 | A | | 12/1992 | Errani | 70/493 |
| 5,224,365 | A | * | 7/1993 | Dobbs | 70/394 |
| 5,355,702 | A | * | 10/1994 | Escribens | 70/395 |
| 5,520,035 | A | | 5/1996 | Eizen et al. | 70/358 |
| 5,533,369 | A | | 7/1996 | Valdajos-Gallego | 70/493 |
| 5,706,683 | A | * | 1/1998 | Napier | 70/398 |
| 5,724,841 | A | | 3/1998 | Botteon | 70/493 |
| 5,775,144 | A | | 7/1998 | Pagalday | 70/358 |
| 5,956,986 | A | * | 9/1999 | Vonlanthen | 70/492 |
| 6,119,495 | A | * | 9/2000 | Loreti | 70/340 |

* cited by examiner 2
11
203
212
130
11

2
11
203
215
216
217
208
11
203

212
209
221
225
211
214
213

MOVEABLE ELEMENT KEY AND KEY HANDLE AND LOCK

TECHNICAL FIELD

The present invention relates to an improved key, key handle and lock.

BACKGROUND ART

Prior art sidebar locks include a cylindrical plug which is mounted into an outer housing or shell in which the plug rotates. The shell is mounted in a suitable latch structure. The plug is locked within the shell by interference between the shell and the plug. This locked state occurs when sidebars from the plug are extended into sidebar grooves located along the sides of the shell. This prevents the plug from rotating with respect to the shell.

The locks are provided with sidebar pins which are directed from the sidebars and which protrude towards the interior of the plug. When the lock is in a locked condition, the sidebar pins do not align with complementary holes in tumblers that are located in the plug. Consequently, unless a correct key is inserted, the sidebar cannot be withdrawn into a sidebar slot which runs the length of the plug. When the correct key is inserted, the tumblers are simultaneously raised to varying degrees so that the tumbler holes are aligned with the sidebar pins. Consequently, the sidebars are able to be received into the slots in the side of the plug, thus no longer acting as an obstacle to the rotation of the plug within the shell. Hence, the lock assumes an unlocked state because the sidebars no longer act as obstacles to the rotation of the plug, Although such locks afford a high degree of security, it would be desirable if the resistance of the lock to unauthorised unlocking was increased even further.

It is an object of the present invention to provide any one of: a high security key, a handle for such a key, and a complementary lock which is operated by such a key.

SUMMARY OF THE INVENTION

According to a first aspect of the present invention, there is provided a key including an actuator which has an operation means and an interaction means, the arrangement being such that operatively, if the key is inserted into a lock, a force is applied to the operation means and the position of the interaction means is altered.

Preferably, the key is operatively adapted such that the force applied to the operation means is supplied by the manual force which a user exerts in inserting the key through the opening of the lock.

Preferably, the alteration of the position of the interaction means is achieved by the actuator being rotatable relative to the body of the key.

Alternatively, the alteration of the position of the interaction means may be achieved by the actuator being pivotable relative to the body of the key.

Preferably, the operation means comprises a part of the actuator positioned and adapted to be forced against a face of the lock during lock insertion.

Preferably, the interaction means is operatively adapted to interact with the lock in a locking or unlocking action therefor, the alteration of the position of the interaction means being part of the locking or unlocking action.

Preferably, the interaction means is arranged and operatively adapted such that, upon key insertion, the interaction means is substantially positioned within the lock.

Preferably, the interaction means comprises a protrusion from the actuator.

Preferably, the key is provided with a key blade, the actuator being positioned alongside the blade.

The key may be provided with at least two blades, and the actuator may be aligned along a plane lying between the two blades.

Each blade may be connected to a handle portion of the key, and the operation means of the actuator may be substantially shielded by the handle portion, while the interaction means may be shielded at least partly by the blade portions.

Preferably, the blade or each of the blades further includes teeth for operation of lock tumblers.

Preferably, the key further includes a biasing means for biasing the actuator into a first position when the key is not inserted into a the lock.

Preferably, in said first position, a part of said operation means protrudes beyond a surface of the key, such that said part is operatively adapted to abut the face of the lock upon lock insertion.

According to a second aspect of the invention, there is provided a key handle including an actuator which has an operation means and an interaction means, wherein, upon applying a force to the operation means, the position of the interaction means is altered, the key handle being adapted for a key blade to be attached thereto to form a key which is operatively adapted to be inserted through an opening in a face of a lock.

According to a third aspect of the invention, there is provided a lock for operation by a key, said key including a moveable actuator having an operation means and an interaction means, said lock including an interference means responsive to the interaction means to release the lock.

Preferably, the interference means includes a blocking element that obstructs part of the lock so as to prevent the occurrence of a step that is necessary for the unlocking of the lock.

In an embodiment, the interference means comprises a relocker bar supported by an anvil, the anvil being responsive to the interaction means to raise and lower the relocker bar so that in, a locked position, the relocker bar obstructs sidebar grooves of the lock while, in an unlocked position, the relocker bar is clear of the sidebar grooves.

Preferably, the lock further including tumblers responsive to teeth located on a blade of the key for moving the tumblers from a position where the tumblers prevent rotation of a plug of the lock relative to a shell surrounding said plug.

According to a fourth aspect of the invention, there is provided a security system including:

a) a key including an actuator means, having an operation means and an interaction means, wherein upon applying force to the operation means the position of the interaction means is altered; and b) a lock for operation by the key including an interference means for locking a plug of the lock to a surrounding lock shell, said interference means being responsive to the interaction means for unlocking of said lock.

According to a fifth aspect of the invention, there is provided a security system including:

a) a key as described above; and b) a lock as described above;

wherein the actuator of the key interacts with the interference means of the lock, such that the alteration of the position of the interaction means of the key causes an alteration of the position of the interference means of the lock so as to achieve unlocking of the lock.

BRIEF DESCRIPTION OF THE DRAWINGS

In order that the invention might be more fully understood, embodiments of the invention will be described, by way of example only, with reference to the accompanying drawings, in which.

DESCRIPTION OF THE EMBODIMENTS

Figure 1:
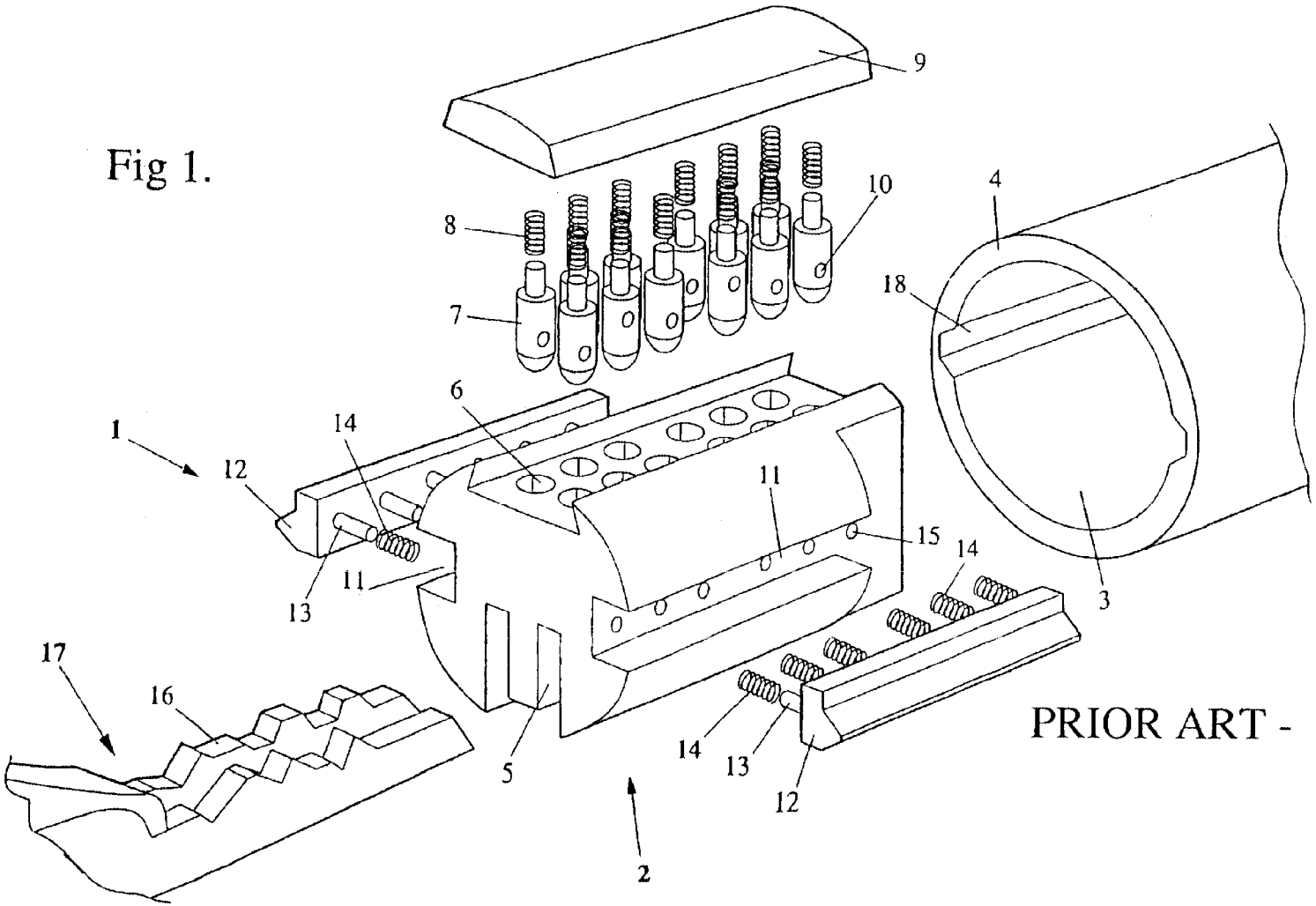
FIG. 1 illustrates an exploded view of a prior art lock.

The present embodiment will be discussed in the context of a prior art Bilock ™ device manufactured and sold by the applicant. These prior art devices make use of dual bladed keys for high security applications. Referring to FIG. 1, there is depicted a prior art plug lock 1. The lock 1 has a removable plug 2 which is slideably received in a longitudinal cavity 3 of a housing 4. The plug 2 has a keyway 5 and a plurality of tumbler bores 6. The tumbler bores 6 are aligned with the keyway 5 and are receptive to pin tumblers 7. The tumblers 7 are inwardly biased in the tumbler bores 6 by tumbler springs 8 which, in turn, are secured in the bores 6 by a cover 9. The tumblers 7 are each provided with a transverse tumbler pin hole 10 as is known in the art of sidebar locks. On either side, the plug 2 is provided with a longitudinally disposed sidebar recess 11. Each recess 11 is adapted, when the lock is in an unlocked state, to accommodate a sidebar 12. The sidebars 12 include a series of pins 13 disposed along the side of the sidebar. The pins 13 face the plug 2. The sidebars 12 are biased away from the plug 2 by sidebar springs 14 or by other biasing means known in the art. A series of transverse bores 15 are provided along the length of each of the sidebar recesses 11. The transverse bores 15 pass through the plug 2.

When the blade 16 of a correct key 17 is inserted into the keyway 5, the transverse bores 15 each communicate with the tumbler bores 6, and match up with the pin holes 10 on the tumblers. This allows the sidebar 12 to be withdrawn into the sidebar recess 11 when sufficient force is applied to overcome the sidebar springs 14. This force may be applied when the user exerts a rotational torque on the plug by rotating the inserted key 17, such that the sidebars 12 are forced into the sidebar recesses 11 as a result of radial forces exerted on the sidebars. The radial forces arise from the angled sides of sidebar slots 18 found in the housing 4. Consequently, the lock 1 is said to be in an unlocked state when the sidebars 12 are positioned generally within the sidebar recesses 11 to the extent that the sidebars 12 no longer hinder the rotation of the plug 2 within the cavity 3.

Figure 2:
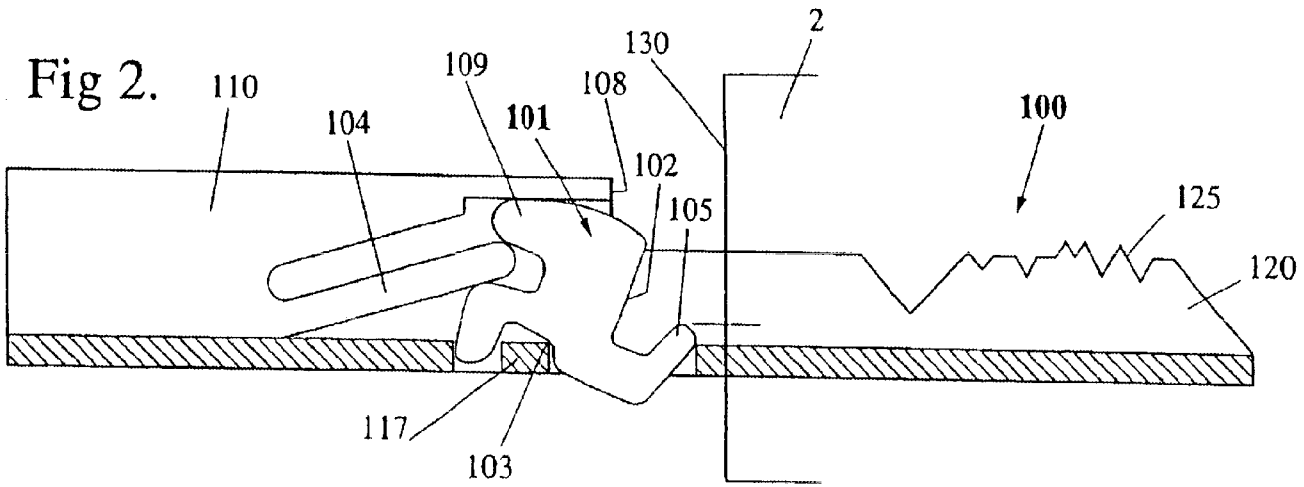
FIG. 2 illustrates a cross-sectional view of an embodiment of a key showing the orientation of an actuating member when the key is not inserted into a lock.

FIG. 2 shows a cross-sectional view of an embodiment of a key 100. The key 100 includes a blade 120 and a handle part in the form of handle portion 110. The key is operatively adapted to be inserted through an opening or keyway in a face 130 of a lock. The blade 120 of the key is provided with teeth 125 which are intended for interactive operation of lock tumblers (not shown) found in the lock. In the embodiment, the blade 120 is preferably free from holes or apertures in the upright faces of the blade, since such holes would act as areas of weakness or of stress concentration.

The key 100 includes an actuator which is embodied in the form of an actuator piece 101. In the embodiment in FIGS. 2 to 3C, the actuator piece 101 is shown as part of the key 100 which has dual blades 120. In such a dualbladed embodiment, the actuator piece 101 is positioned between the two blades 120.

The actuator has an operation means and an interaction means. The operation means comprises a part of the actuator which, in the present embodiment, is in the form of an edge 102 of the actuator piece 101 that is adapted to receive an applied force. The actuator edge 102 is arranged and adapted to be forced against the face 130 of the lock when the key 100 is inserted into the lock. In the embodiment, the interaction means is in the form of a protrusion from the actuator in the form of anterior horn 105. When a force is applied to the edge 102 of the actuator piece, the force causes the position of the horn 105 to be altered.

As a result of the movement of the actuator, the position of the interaction means is altered. For example, in the embodiment, the movement of the actuator piece 101 causes the alteration of the position of the horn 105.

The actuator piece 101 is able to pivot relative to the body of the key 100. In the embodiment of FIG. 2, the actuator piece 101 pivots freely about an edge 103 of the transverse spine segment 117. In alternative embodiments, the actuator may rotate relative lo the key body, rather than merely pivot.

The key includes a biasing means for biasing the actuator into a first position when the key is not inserted into the lock. FIG. 2 shows the actuator piece in a first position. A biasing means, in the form of resilient tongue 104, contacts and urges the actuator piece back towards the first position during lock insertion such that, when the key is withdraw from the lock, the actuator returns to the first position. The resilient tongue 104 pushes upwards on an arm 109 of the actuator piece. Thus, prior to insertion of the key 100 into the lock, the resilient tongue 104 forces the actuator piece 101 to pivot clockwise about the transverse edge 103. In this first position, prior to full insertion of the key, the anterior horn 105 of the actuator piece 101 assumes a low profile suitable for entry into the keyway of the lock, as seen in FIG. 2. The resilient tongue may be formed, for example, of a suitable plastic material.

Figure 3A:
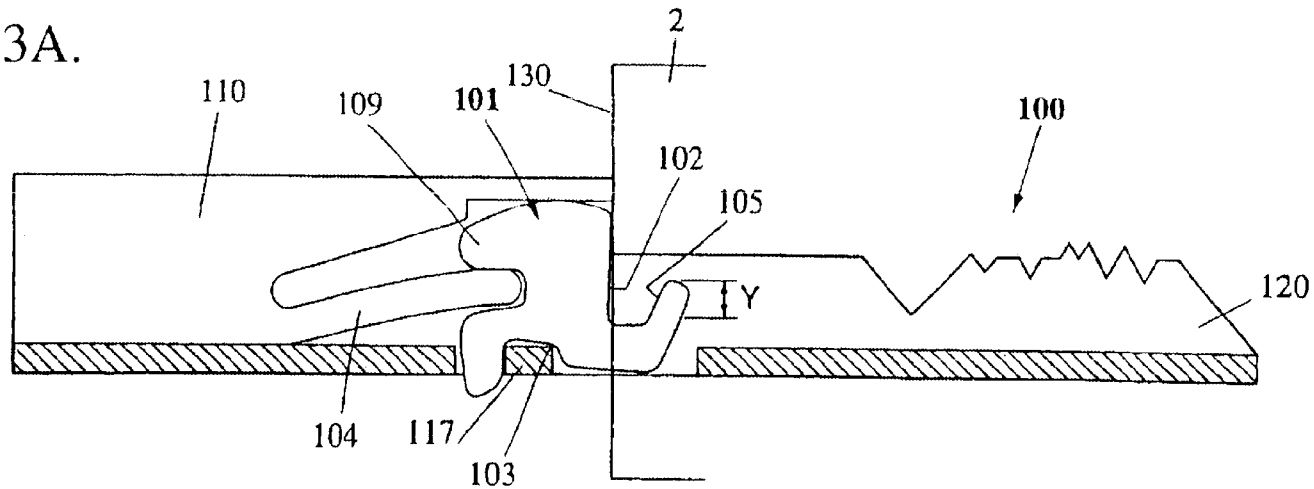
FIG. 3A illustrates a cross-sectional view of the key of FIG. 2 showing the orientation of the actuating member when the key is inserted into the lock.

In FIG. 3A, when the user forcibly inserts the key 100 into the lock, the edge 102 of the actuator piece abuts the lock face 130. Thus, the force of inserting the key causes the edge 102 of the actuator piece to exert a force on the lock face 130. Concurrently, there is a equal and opposite reaction force from the lock face 130 that acts against the edge 102 of the actuator piece. Thus, the edge 102 of the actuator piece is said to be operatively adapted to receive the reaction force applied by the surface of the lock face 130. This reaction force, acting on the edge 102 of the actuator, causes an alteration in the position of the interaction means, which is embodied as the horn 105. The face 130 of lock forces the actuator piece 101 to rotate or pivot counter-clockwise about the edge 103. This occurs as and when the force created by the insertion of the key by the user is sufficient to overcome the biasing force of the resilient tongue 104. Consequently, as the actuator piece rotates counter-clockwise, this causes the position of the horn 105 to be altered. Thus, the horn 105 rises up through a distance Y, as indicated in FIG. 3A. Hence, the horn 105 functions as a moveable element that is adapted to interact with a mechanism of the lock. The role of the actuator is to provide the movement so that the position of the interaction means, for example the horn 105, can be altered.

The purpose of the interaction means is to provide a moving element that can interact, in some manner, with the mechanism of the lock. This provision of a moving element on the key, or key handle, enables locks to be designed with mechanisms that can only be fully activated when the interaction means is brought into play with the lock mechanism.

A principle underlying the design of the embodiment in FIGS. 2 and 3A is that rotational or pivotal motion of the actuator piece 101 causes the horn 105 to move in a manner that is transverse to the longitudinal axis of the key. In FIG. 3A, this transverse movement of the horn 105 is spanned by distance Y. Thus, this transverse movement, of the interaction means, may be designed to participate in the locking and/or unlocking mechanism of the lock. It is appreciated that an unauthorised user, such as a burglar, may more readily replicate a motion in the lock that is activated by a force acting parallel to the longitudinal axis, for example, by inserting a long rod into the keyway. However, it may not be as easy for the unauthorised user to replicate a motion that is activated by a force acting transverse or perpendicular to the longitudinal axis.

Furthermore, in the embodiment, the horn 105 is able to exert a transverse force which may be equivalent to the force applied by the user when inserting the key into the lock, as explained above. This is because the force of key insertion is used to move the actuator which, in turn, causes the interaction means to move in the transverse manner. This leads to an advantage that the transverse force, offered by the interaction means, may be greater than some of the transverse forces that have been effected in the prior art. In the prior art, transverse motions inside the lock have been effected by internal springs or the like that may not offer as much force as that which is offered by the interaction means of the present embodiment, which is activated by the force of key insertion, The transverse force offered by the interaction means, such as the horn 105, enables lock designers to create locking mechanisms that incorporate larger components for or in the lock which must be moved by the transverse force. Later in the specification, embodiments of lock will be described with reference to FIGS. 6A and 7 which include components that require a relatively large force to be moved.

Since the interaction means is intended to interact with the lock mechansim, the interaction means must be arranged such that, upon key insertion, the Interaction means will preferably be within the lock. In this embodiment, the interacton means, formed as the horn 105, protrudes beyond the face 108 of the handle portion 110, as shown in FIG. 2. Hence, when the key 100 is inserted into the lock, the face 108 of the handle portion abuts against the lock face 130. Thus, the fact that the horn 105 protrudes beyond the face 108 of the handle portion means that the horn 105 is inserted into the interior of the lock, and the alteration of the position of the horn 105 can participate In the Internal operation of the lock.

In FIG. 2, the body of the actuator piece 101 is substantially shielded by the handle portion 110. However, the operation means, formed as the edge 102 of the actuator piece, protrudes slight beyond the face 108 of the handle portion, as seen in FIG. 2. This is so that the edge 102 of the actuator piece will be able lo abut the lock face 130 during key insertion.

In other embodiments, the interaction means, which is preferably supported by the key handle, may be called upon to interact with an external mechanism that is located outside the lockface. In such other embodiments, the interaction means—for example the horn 105—need not protrude beyond the face 108 of the handle portion. Instead, the external mechanism of the lock would penetrate the key handle to interact with the interaction means of the key. However, in such other embodiments, the external mechanisms of the lock would be exposed to damage. For this reason, the earlier described embodiment, where the interaction means enters the lock, is preferred over the other embodiments where the lock mechanism, which interacts with the interaction means, is external or outside of the lock face.

Figure 3B:
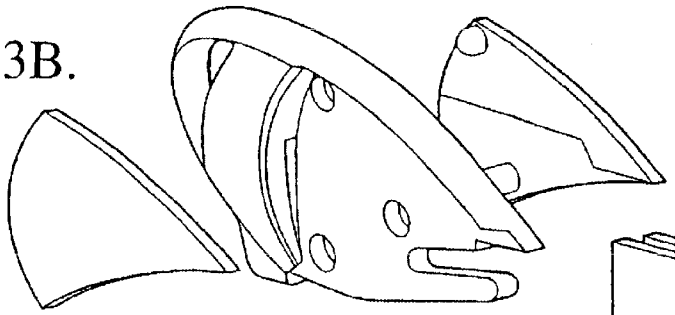
FIG. 3B illustrates an exploded view of an embodiment of a key having an actuator.
Figure 3C:
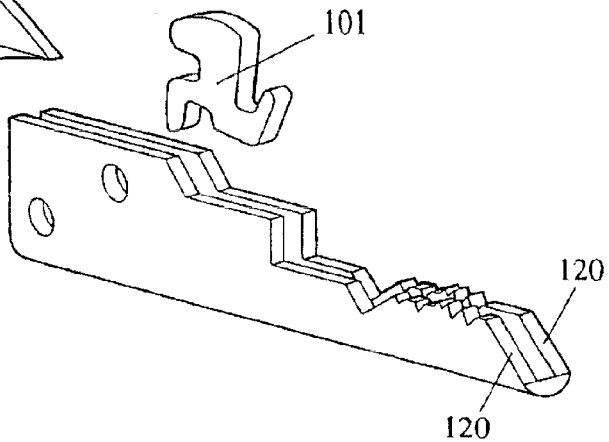
FIG. 3C illustrates the embodiment of the key of FIG. 3B in an assembled state.
Figure 3C:
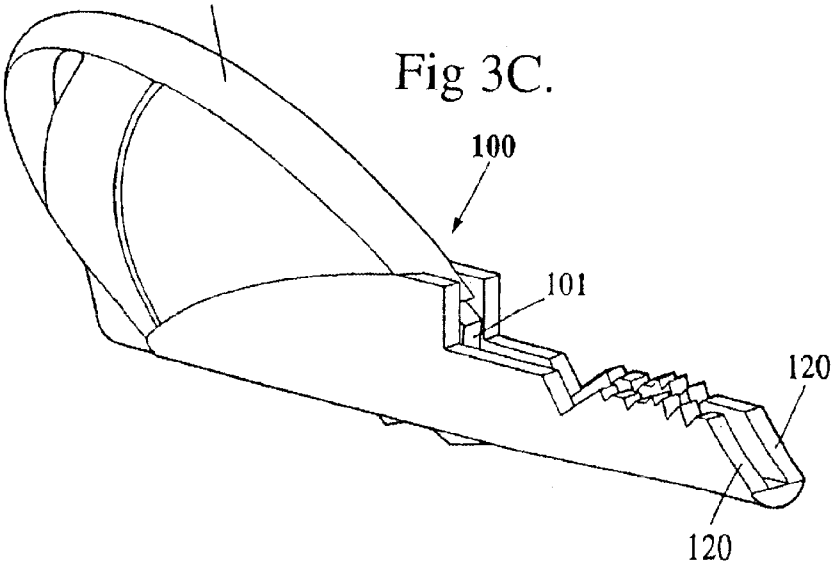

In the embodiments in FIGS. 2 to 3C, the keys are provided with two or more blades. The plane of the actuator lies alongside one of the blades, and preferably is aligned along a plane which lies between two of the blades 120, and/or between two walls of the handle portion 110. This allows the movement of the actuator piece 101 to be shielded by planar surfaces of the key. For example, in FIG. 2, the body of the actuator piece 101 is substantially shielded by the surfaces of the handle 110, and the horn 105 is substantially or at least partially shielded by the surfaces of the blades 120. Thus, the actuator piece 101 receives a degree of protection from damage, which extends its life span.

Figure 3D:
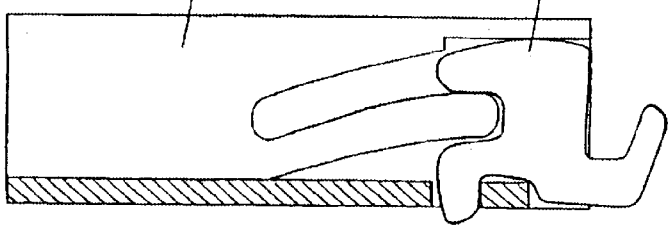
FIG. 3D illustrates an embodiment of a key handle having an actuator in which a key blade has not yet been attached to the key handle.

In FIG. 3D, a further embodiment of the invention is illustrated which is in the form of a handle portion 110 having an actuator piece 101. No blade portion is attached. In all respects, the handle portion 110 in FIG. 3D is the same as the one illustrated in FIGS. 2 and 3A, except that a blade portion 120 has not yet been attached. This embodiment shows that the invention may be embodied as a handle portion having an actuator, with the intention that the user, such as a locksmith or end user, will subsequently attach a blade portion. The blade portion may be of a conventional design, and all the features of the embodiments may be found only on or supported by the handle portion. Hence, the invention in its broadest aspect is not limited to having a blade portion, since the user may attach a-conventional blade portion.

Embodiments will now be described of locks that are capable of interacting with the interaction means of embodiments of keys or key handles, such as the ones described above.

Figures 4A, 4B, 5:
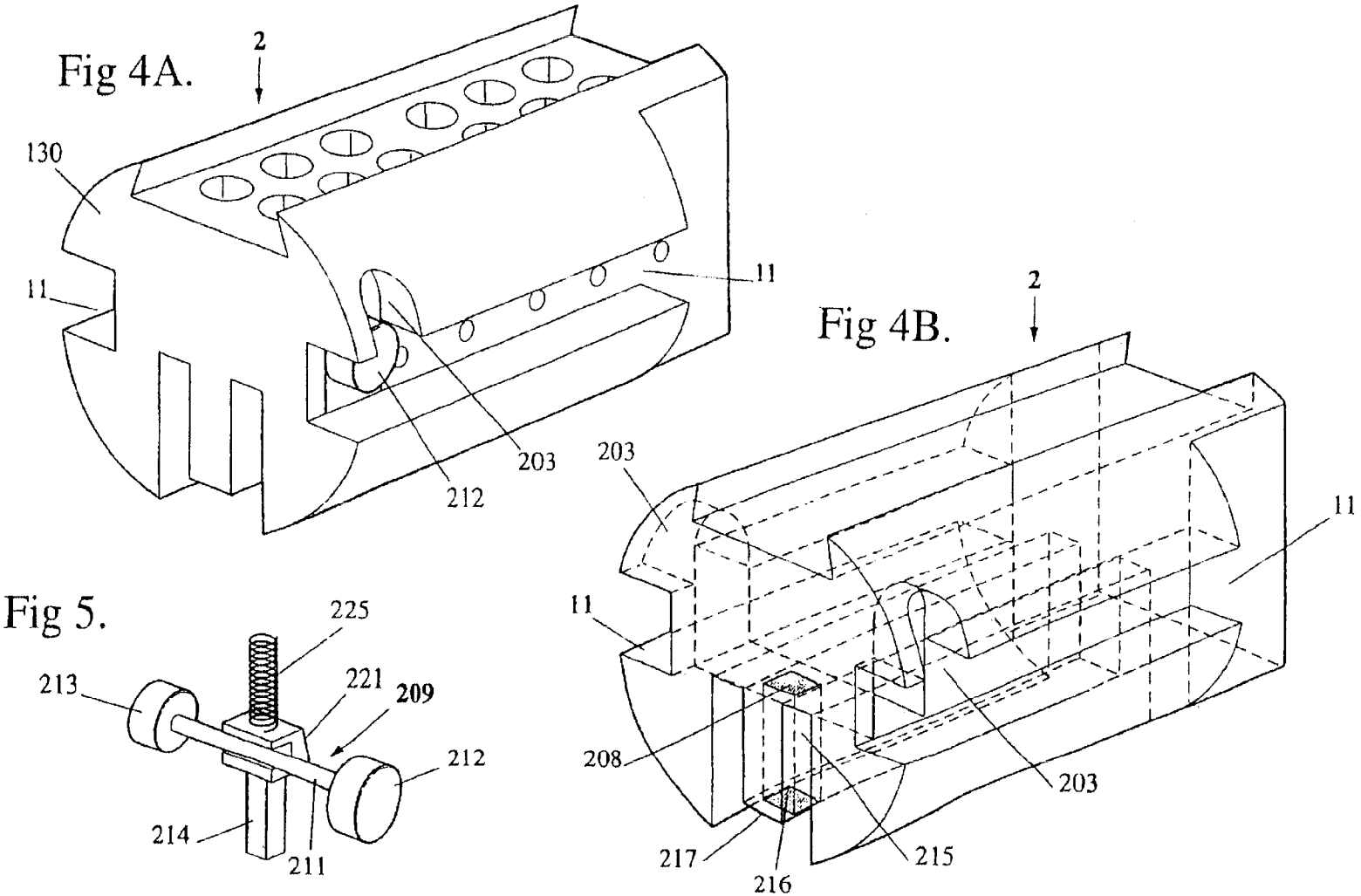
FIG. 4A illustrates an embodiment of a lock component which is operable by the key of FIG. 2.
FIG. 4B is the lock component of FIG. 4A illustrated with the internal configuration shown in outline.
FIG. 5 illustrates a relocker bar which is used for locking and unlocking the lock component of FIGS. 4A and 4B.

FIG. 4A illustrates an embodiment of a lock which contains a mechanism that is locked and/or unlocked as a result of interaction with an interaction means found on embodiments of keys or key handles of the type described above.

A comparison is made between the embodiment of FIG. 4A in contrast to the prior art lock of FIG. 1. (Like parts are designated with like numerals, both in the prior art and in the embodiment, only for ease of understanding the present embodiment). In contrast to the prior art of FIG. 1, the lock in FIG. 4A is provided with a passage 203 (best seen in FIG. 6B). The passage 203 extends transverse to the longitudinal axis of the plug, extending from one sidebar groove 11 to the other side bar groove 11 on the other side of the plug.

In FIG. 4A, the lock plug 2 is provided with an interference means in a form which includes two discs 212, 213, which are more clearly seen in FIG. 5. In FIG. 5, the discs 212, 213 are connected by a crossbar 211 which, together with the discs, form a relocker bar 209 which has an appearance of a dumbbell. The relocker bar 209 is provided with a downwardly depending post or support 214. The crossbar 211 is engaged by the head of an anvil 221.

Figure 6A:
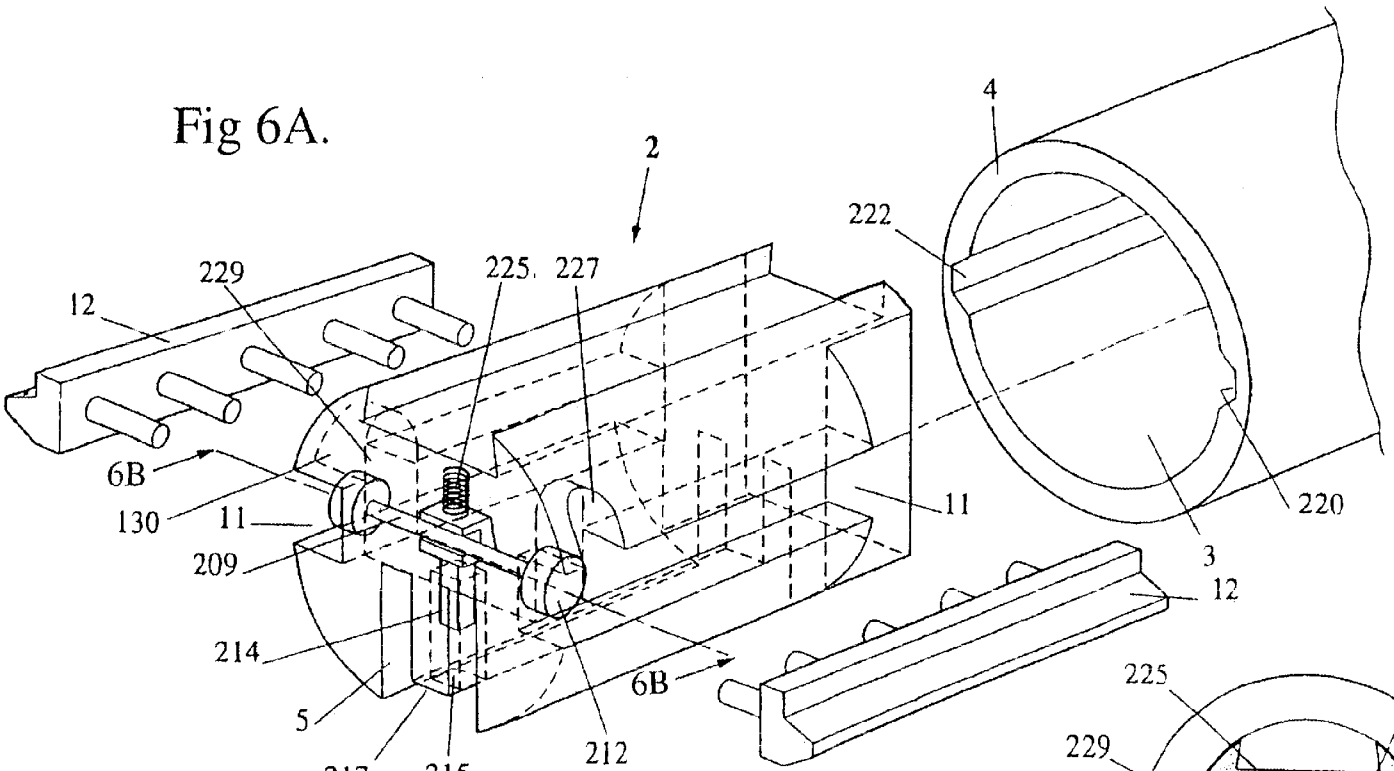
FIG. 6A shows a lock with the lock component of FIG. 4A illustrated with the relocker bar of FIG. 5 located within the plug of the lock.
Figure 6B:
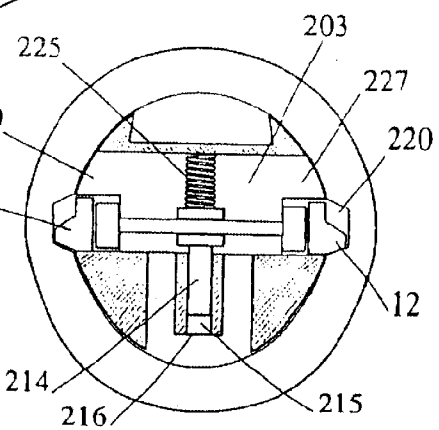
FIG. 6B shows a cross-section of the lock of FIG. 6A, taken along a plane that passes through 6B—6B of FIG. 6A.

In FIG. 4A, when the discs 212, 213 are moved-up into the passage 203, the discs in this upper position do not obstruct the sidebar grooves 11. However, when the discs 212, 213 are moved down into the sidebar grooves 11 (as shown in FIG. 6B), the discs obstruct and prevent the sidebars 12 from entering the sidebar grooves 11. Thus, when the discs are in this lower position, the lock is said to be in a locked position. Hence, the movement of the discs 212, 213 of the relocker bar 209 is an integral part of the locking and unlocking mechanism of the lock. As will be described, the movement of the discs is achieved by interaction with an interaction means of an embodiment of a key similar to the type described above.

The transverse movement of the horn 105, found on the actuator piece of the key in FIG. 2, is used to impart the upward and downward movement of the discs 212, 213. In order to enable the horn 105 to impart motion to the discs 212, 213, the lock is provided with a passageway through which the interaction means of the key is able to interact with the interference means of the lock. In FIG. 4B, the passageway in the preferred embodiment includes a vertical or upright channel 215. The vertical channel 215 communicates with the passage 203. The upper opening 208 of the vertical channel 215 begins at a lower surface in the passage 203, and extends down to the base of the keyway ridge 217, forming a lower opening 216 for the channel 215. In FIG. 6A, when the relocker bar 209 is installed in the plug 2, a biasing spring 225 is included for biasing the discs 212, 213 of the anvil and the relocker bar 209 downwardly towards the locking position.

In FIG. 6A, the relocker bar 209 is shown positioned within the plug lock of FIGS. 4A. The lock is operated by the key of FIG. 2, as will now be described. The horn 105 (of FIG. 2) is able to move within the lock, inside the upright channel 215. Inside this upright channel, the post 214 of the relocker bar 209 is also positioned, such that in the confines of the channel 215, the lip of the horn 105 is able to abut up against the base of the post 214. The post 214 of the anvil 221, shown in FIG. 5, is dimensioned to be received into the vertical channel 215.

Referring to FIGS. 6A and 6B, in the locked position, the sidebars 12 are urged away from the plug 2 such that the sidebars engage in grooves 220, 222 in the shell 4, in a similar manner as in the prior art lock of FIG. 1. However, in the embodiment of FIG. 6A which is shown in the locked position, the biasing spring 225 forces the relocker bar 209 downwards so that the discs 212, 213 obstruct the sidebar grooves 11. Thus, in the locked state, the discs 212, 213 of the relocker bar sit at least partially in the grooves 11, and thereby prevent the sidebars 12 from returning into the grooves 11. Accordingly, the discs 212, 213 at least partially fill the sidebar grooves 11 so that, even if force is applied to the key in an attempt to rotate the plug 2 relative to the cavity 3 of a housing 4, there is no possibility that the sidebars 12 will retract back into the sidebar grooves 11. Therefore, when the relocker bar 209 assumes the lower position, as illustrated in FIG. 6A, rotation and hence unlocking of the plug is prevented.

In order to rotate the plug 2 within the cavity 3, it is necessary that the relocker bar 209 be raised up out of the way, so that the discs 212, 213 will no longer obstruct the sidebar grooves 11. To effect this unlocking, the key of FIG. 2 is inserted into the keyway 5 of the plug. The actuator piece 101 is forced against the face 130 of the lock. This causes the horn 105 to be raised through the vertical channel 215, so that the horn 105 thereby forces the post 214 of the relocker bar upwards.

The upward movement of the relocker bar 209 lifts and forces the discs 213 and 212 upwards into the housing recesses 227, 229 of the passage 203, so that the discs no longer obstruct the sidebar grooves 11. It is then simply a matter for the user to apply a rotational force to the lock by means of the key, in order to force the sidebars 12 against the grooves 220, 222 of the shell 4. This causes the sidebars 12 to be retracted into sidebar grooves 11 of the plug. While the operation of the lock tumblers has not been explained in relation to the operation of the lock of FIG. 4A, preferably the lock includes tumblers and associated components, whose operation is standard and similar to that described in relation to the prior art lock of FIG. 1.

Figure 7:
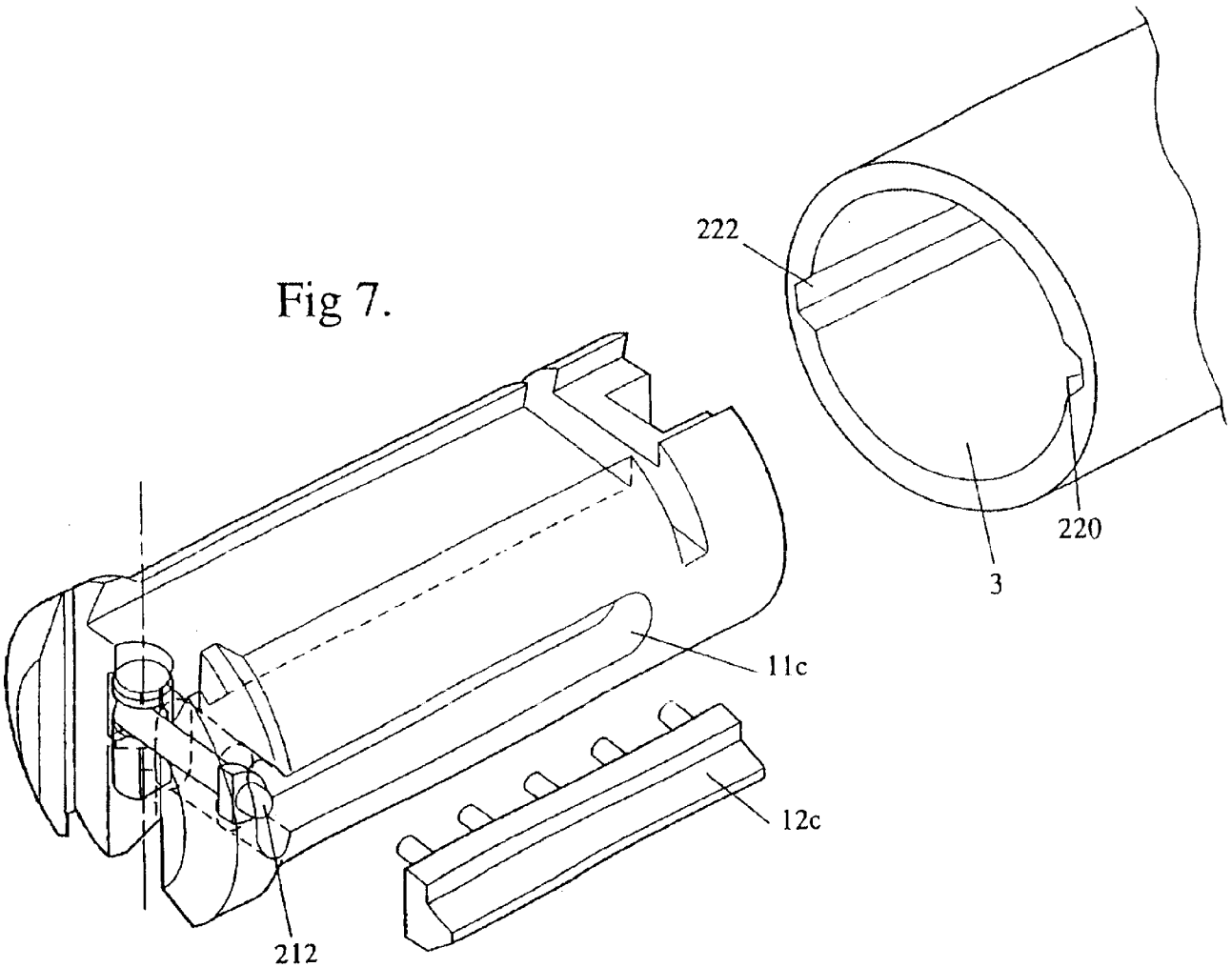
FIG. 7 illustrates an exploded view of a further embodiment of a lock which varies from the embodiment of FIGS. 4A to 6B in that the further embodiment has a relocker bar having only a single sidebar and only a single interference element.
Figure 9:
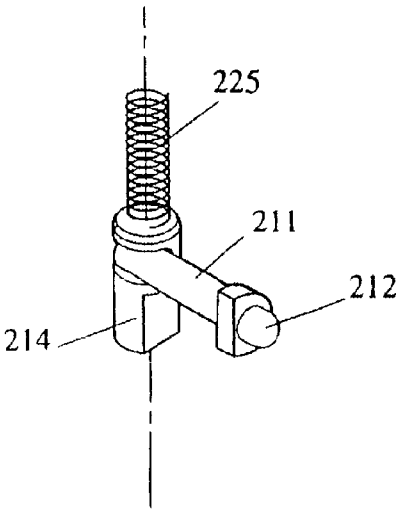
FIG. 9 is a detailed view of the embodiment of the relocker bar used in the lock of FIG. 7.
Figure 8:
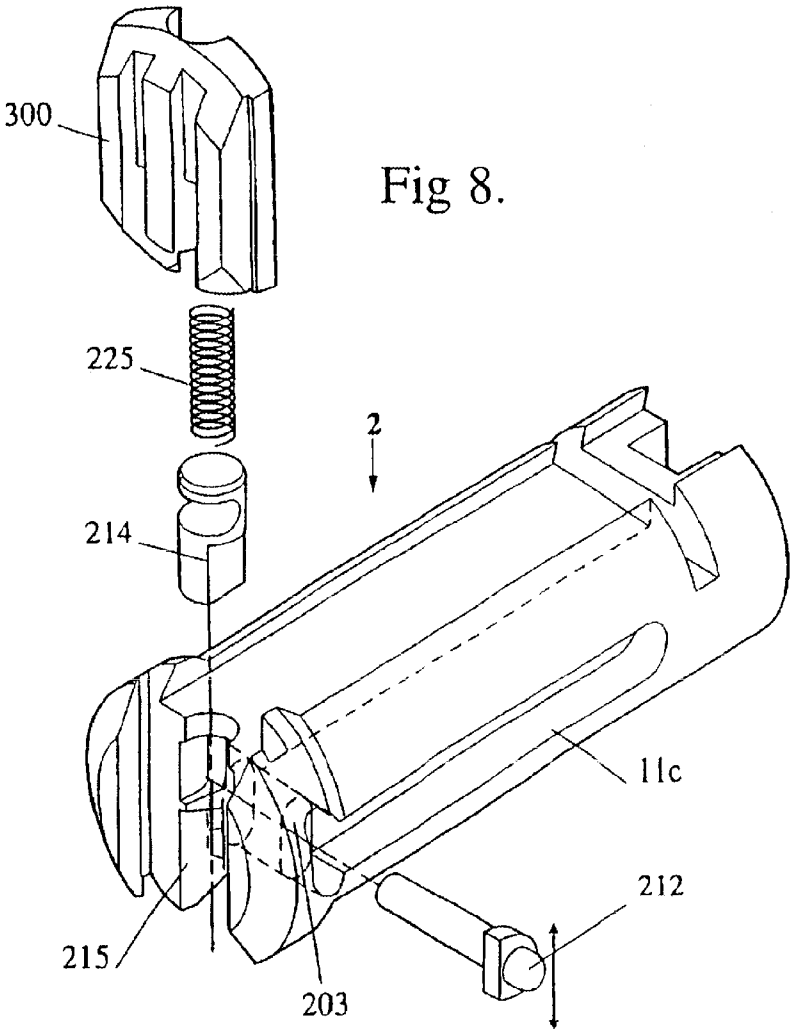
FIG. 8 is a further exploded view of components of the lock of FIG. 7.

In another embodiment of a lock, illustrated in FIGS. 7 to 9, an interference means is used that differs from the relocker bar of FIG. 5 in that, rather than having two discs, only one interference element is used. Here, the interference element is in the form of a block 212. Also, although the shape or design of the components of this other embodiment differ from the embodiment of FIG. 6A, the function remains the same. Since only one interference element is used, there is only need for one sidebar groove 11C, and one sidebar 12C.

FIG. 8 shows an exploded view of a cover 300 which is removeable to reveal the inner passage 203 and upright channel 215. Once the components of the block 212 and support 214 are placed within the plug 2, the cover 300 is used to seal the opening of the plug. FIG. 9 illustrated the further embodiment of the relocker bar in an assembled state.

An underlying principle of the embodiments is to provide a mechanism, included in a key or supported by the key handle, which is able to impart a motion that can interact with the locking mechanism of the lock. Embodiments have been described in which the actuator imparts a transverse motion to the interaction means, and it will be evident to those skilled in the art that other actuators may be conceived that can impart a similar motion to the interaction means. Hence, the invention in its broadest aspect is not limited to the shape and configuration of the actuator piece 101 illustrated in FIG. 2 or 3D.

Furthermore, in the preferred embodiments, the plane of the actuator piece is parallel to the side walls of the key blades, but in other embodiments, the plane of the actuator may be transverse to the plane of the key blades.

The key in FIG. 2, and the lock of FIG. 6A or 7, combine together to form an embodiment of a security system in which the actuator of the key interacts with the interference means of the lock, such that the alteration of the position of the interaction means of the key causes an alteration of the position of the interference means of the lock, so as to achieve unlocking of the lock.

Although only two embodiments of locks, which are complementary to a key according to an embodiment of the invention, have been explained, it is noted that other designs will be apparent to those skilled in the art. For example, according to another embodiment, the horn of the actuator piece might push a tumbler in order to position it so that it does not interfere between the plug and shell. Similarly, the key could be of other designs. For example, the operative force may be applied to a moveable element by squeezing, rotating or pushing the handle of the key, rather than by forcing the actuator against the face of the lock. The invention may be embodied in a key with only one blade, rather than two or more blades. In such cases, the interaction means may be inside the single blade, or alongside the blade. Furthermore the moveable element might slide or alternatively move along a curved track, rather than rotate or pivot. As seen in FIGS. 3B and 3C, the external appearance of the key handle may be modified without affecting the function of the mechanism of the invention. Accordingly, the appended claims should be interpreted broadly and are not limited to the preferred embodiments described hereinbefore.

What is claimed is:

1. A key, comprising:

at least one key blade; and at least one rotatable actuator movable relative to said key blade, said actuator being integrally formed and having an operation means and an interaction means;

wherein said actuator is positioned alongside said at least one key blade and said actuator having an axis of rotation generally normal to the length of said key blade;

wherein when said key is inserted into a suitable lock, the force applied to said operation means by the face of the lock results in the rotation of said actuator, whereby the position of said interaction means is altered relative to said key blade; and wherein operatively the alteration of the position of said interaction means is a subsidiary part of at least one of locking and unlocking action of the lock.

2. The key according to claim 1, wherein said key is operatively adapted such that the force applied to said operation means is supplied by a manual force which a user exerts in inserting said key into the lock.

3. The key according to claim 1, wherein said interaction means is arranged and operatively adapted such that, upon said key insertion, said interaction means is substantially positioned within the lock.

4. The key according to claim 3, wherein said interaction means comprises a protrusion from said actuator.

5. The key according to claim 1, wherein said key includes at least two key blades, said actuator positioned between said at least two key blades.

6. The key according to claim 5, wherein each said key blade is connected to a handle portion of said key, said operation means of said actuator being substantially shielded by said handle portion;

wherein said interaction means is shielded at least partially by said at least two key blades.

7. The key according to claim 1, wherein said at least one key blade further comprises teeth for operation of lock tumblers.

8. The key according to claim 1, wherein said key further comprises a biasing means for biasing said actuator into a first position when said at least one key blade is not inserted into the lock.

9. The key according to claim 8, wherein in said first position, at least a portion of said operation means is arranged to abut a face of the lock upon lock insertion.

10. The key according to claim 1, wherein said at least one key blade further comprises teeth for operation of lock tumblers.

11. A key handle, comprising:

at least one rotatable actuator movable relative to at least one key blade, said actuator being integrally formed and having an operation means and an interaction means, said key handle being adapted for said at least one key blade to be attached thereto to form a key;

wherein said actuator is positioned alongside said at least one key blade and said actuator having an axis of rotation generally normal to the length of said key blade;

wherein said operation means comprises a part of said actuator operatively arranged to be forced against a face of a lock during lock insertion of said key;

wherein when said at least one key blade is inserted into a suitable lock, the force applied to said operation means by the face of the lock results in the rotation of said actuator, whereby the position of said interaction means is altered;

wherein operatively the alteration of the position of said interaction means is a subsidiary part of at least one of locking and unlocking action of the lock.

12. The key handle according to claim 11, wherein said key handle is operatively adapted such that the force applied to said operation means is supplied by a manual force which a user exerts in inserting said key into the lock.

13. The key handle according to claim 11, wherein said interaction means is arranged and operatively adapted such that, upon said key insertion into the lock, said interaction means is substantially positioned within the lock.

14. The key handle according to claim 13, wherein said interaction means comprises a protrusion from said actuator.

15. The key handle according to claim 11, wherein said key handle being adapted for at least two said key blades to be attached thereto to form said key;

wherein said actuator positioned between said at least two key blades.

16. The key handle according to claim 15, wherein each said key blade is connected to said key handle, said operation means of said actuator is substantially shielded by said key handle;

wherein said interaction means is shielded at least partially by said at least two key blades.

17. The key handle according to claim 12, wherein said at least one key blade further comprises teeth for operation of lock tumblers.

18. The key handle according to claim 11, wherein said key handle further comprises a biasing means for biasing said actuator into a first position when no force is applied to said operation means.

19. The key handle according to claim 18, wherein in said first position, at least a portion of said operation means is arranged to abut a face of the lock upon lock insertion.

20. The key handle according to claim 11, further comprising at least one part that forms a handle body graspable by a user, said at least one key blade being adapted to fit into said handle body.

21. The key handle according to claim 11, further comprising resilient retaining means for retaining a moveable element in said key handle, said moveable element including said operation means and said interaction means.

22. The key handle according to claim 11, wherein said at least one key blade further comprises teeth for operation of lock tumblers.

23. A lock for operation by a key, said lock comprising:

a plurality of tumblers configured for engagement with a key blade for providing part of at least one of locking and unlocking action of said lock; and at least one interference means responsive to an interaction means of a rotatable actuator disposed on the key and movable relative to the key blade, to provide a subsidiary part of at least one of locking and unlocking action of said lock;

wherein said actuator is positioned alongside said key blade and said actuator having an axis of rotation generally normal to the length of said key blade;

wherein said actuator being integrally formed and further comprising an operation means, said operation means operatively arranged to be forced against a face of the lock during lock insertion;

wherein when said key is inserted into the lock, the force applied to said operation means by the face of the lock results in the rotation of said actuator, whereby the position of said interaction means is altered relative to said key blade in order to engage said at least one interference means.

24. The lock according to claim 23, wherein said interference means comprises a blocking element that obstructs part of said lock to prevent the unlocking of said lock.

25. The lock according to claim 23, wherein said interference means comprises a relocker bar supported by an anvil, said anvil being responsive to the interaction means of the movable actuator to raise and lower said relocker bar;

wherein said relocker bar obstructs sidebar grooves of said lock in a locked position; and wherein said relocker bar is clear of said sidebar grooves in an unlocked position.

26. The lock according to claim 23, further comprising tumblers responsive to key blade teeth for moving said tumblers from a position where said tumblers prevent rotation of a plug of said lock relative to a shell surrounding said plug.

27. A security system, comprising:

a key including at least one key blade and at least one rotatable actuator movable relative to said at least one key blade, said at least one actuator being integrally formed and including an operation means and an interaction means;

wherein said at least one actuator is positioned alongside said at least one key blade and said actuator having an axis of rotation generally normal to the length of said key blade;

wherein said operation means comprises a part of said at least one actuator operatively arranged to be forced against a face of a lock during lock insertion;

wherein upon applying force to said operation means said actuator is rotated, whereby the position of said interaction means is altered; and a lock for operation by said key, said lock including an interference means for locking a plug of said lock to a surrounding lock shell, said interference means being responsive to said interaction means as a subsidiary for part of at least one of locking and unlocking action of said lock.

28. A lock for operation by a key, said lock comprising:

a plurality of tumblers configured for engagement with a key blade for providing part of at least one of locking and unlocking action of said lock; and at least one interference means responsive to an interaction means of an actuator disposed on the key and movable relative to the key blade, to provide part of at least one of locking and unlocking action of said lock;

wherein said interference means comprises a relocker bar supported by an anvil, said anvil being responsive to the interaction means of the movable actuator to raise and lower said relocker bar;

wherein said relocker bar obstructs sidebar grooves of said lock in a locked position; and wherein said relocker bar is clear of said sidebar grooves in an unlocked position.

* * * * *